US005555658A

United States Patent [19]

Yu

[11] Patent Number: 5,555,658

[45] Date of Patent: Sep. 17, 1996

[54] DECORATIVE LAMP ASSEMBLY ADAPTED TO PROVIDE SILHOUETTING EFFECTS

[76] Inventor: Chai-Chi Yu, No. 24, Lane 1, Ta-Chih St., Tan-Yang Tsun, Tan-Tzu Hsiang, Taichung Hsien, Taiwan

[21] Appl. No.: 449,008

[22] Filed: May 24, 1995

Related U.S. Application Data

[63] Continuation-in-part of Ser. No. 399,135, Mar. 6, 1995.

[51] Int. Cl.[6] ..... G09F 13/06

[52] U.S. Cl. ..... 40/554; 40/433; 362/811

[58] Field of Search ..... 362/320, 321, 362/811; 40/436, 437, 554, 579, 580, 431, 442, 433, 474, 444

[56] References Cited

U.S. PATENT DOCUMENTS

| | | | |
|---|---|---|---|
| 1,871,073 | 8/1932 | Monheim | 40/431 |
| 2,077,632 | 4/1937 | Marsh | 40/437 X |
| 2,138,888 | 12/1938 | Shigley | 362/811 X |
| 2,300,447 | 11/1942 | Glukes | 40/444 |
| 2,360,536 | 10/1944 | Avery | 40/433 |
| 3,050,888 | 8/1962 | Myers et al. | 40/433 |
| 3,080,474 | 3/1963 | Allen | 362/811 X |
| 3,242,330 | 3/1966 | Schoffer | 362/811 X |
| 3,743,828 | 7/1973 | Fiorenzo et al. | 40/444 |
| 3,762,082 | 10/1973 | Mincy | 40/433 |
| 3,900,978 | 8/1975 | Sloan | 40/579 X |

*Primary Examiner*—Joanne Silbermann
*Attorney, Agent, or Firm*—Ladas & Parry

[57] ABSTRACT

A decorative lamp assembly includes an enclosure body having a cover portion and an electric bulb unit fixed in the enclosure body. A bowl-shaped transparent rotary member is mounted rotatably in the enclosure body and is located between the bulb unit and the cover portion. A pattern unit is indicated on the rotary member. A plurality of transparent rotary disks are formed with pattern units and are mounted rotatably within the rotary member between the bulb unit and the cover portion so that rays of light emitted from the bulb unit pass through the rotary disks and the rotary member and penetrate partially the cover portion to display silhouettes of the pattern units of the rotary disks and the rotary member on the external surface of the cover portion. A driving unit rotates the rotary disks and the rotary member.

2 Claims, 3 Drawing Sheets

DECORATIVE LAMP ASSEMBLY ADAPTED TO PROVIDE SILHOUETTING EFFECTS

CROSS-REFERENCE TO RELATED APPLICATION

This invention is a continuation-in-part application of U.S. patent application Ser. No. 08/399,135, which was filed on Mar. 6, 1995.

BACKGROUND OF THE INVENTION

1. Field of the Invention

The invention relates to a decorative lamp assembly, more particularly to a decorative lamp assembly which can provide a silhouetting effect.

2. Description of the Related Art

A conventional decorative lamp assembly usually includes an illuminating lamp unit, a plurality of decorative accessories, and a cover member which generally covers the illuminating lamp unit.

However, the conventional decorative lamp assembly is static relative to the surrounding, thereby creating a dull and monotonous environment.

SUMMARY OF THE INVENTION

The object of the present invention is to provide a decorative lamp assembly which can provide silhouetting effects so as to create a more pleasant surrounding.

Accordingly, the decorative lamp assembly of this invention includes an enclosure body having a cover portion and an electric bulb unit fixed in the enclosure body. A bowl-shaped transparent rotary member is mounted rotatably in the enclosure body and is located between the bulb unit and the cover portion. A pattern unit is indicated on the rotary member. A plurality of transparent rotary disks are formed with pattern units and are mounted rotatably within the rotary member between the bulb unit and the cover portion so that rays of light emitted from the bulb unit pass through the rotary disks and the rotary member and penetrate partially the cover portion to display silhouettes of the pattern units of the rotary disks and the rotary member on an external surface of the cover portion. A driving unit rotates the rotary disks and the rotary member.

A transparent cap member has a plurality of different colored sections and is mounted rotatably in the enclosure body between the bulb unit and the rotary disks in such a manner that the transparent cap member covers the bulb unit.

When the electric bulb unit is energized, the silhouettes of the pattern units of the rotary disks and the rotary member are displayed on the external surface of the cover portion of the enclosure body. When the electric bulb unit is energized and the rotary disks, the rotary member and the cap member are driven to rotate, the silhouettes of the pattern unit of each of the rotary disks and the rotary member are displayed movingly in different colors on the external surface of the cover portion of the enclosure body. The silhouettes may overlap one another so as to provide double silhouetting effects to create a more pleasant environment.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
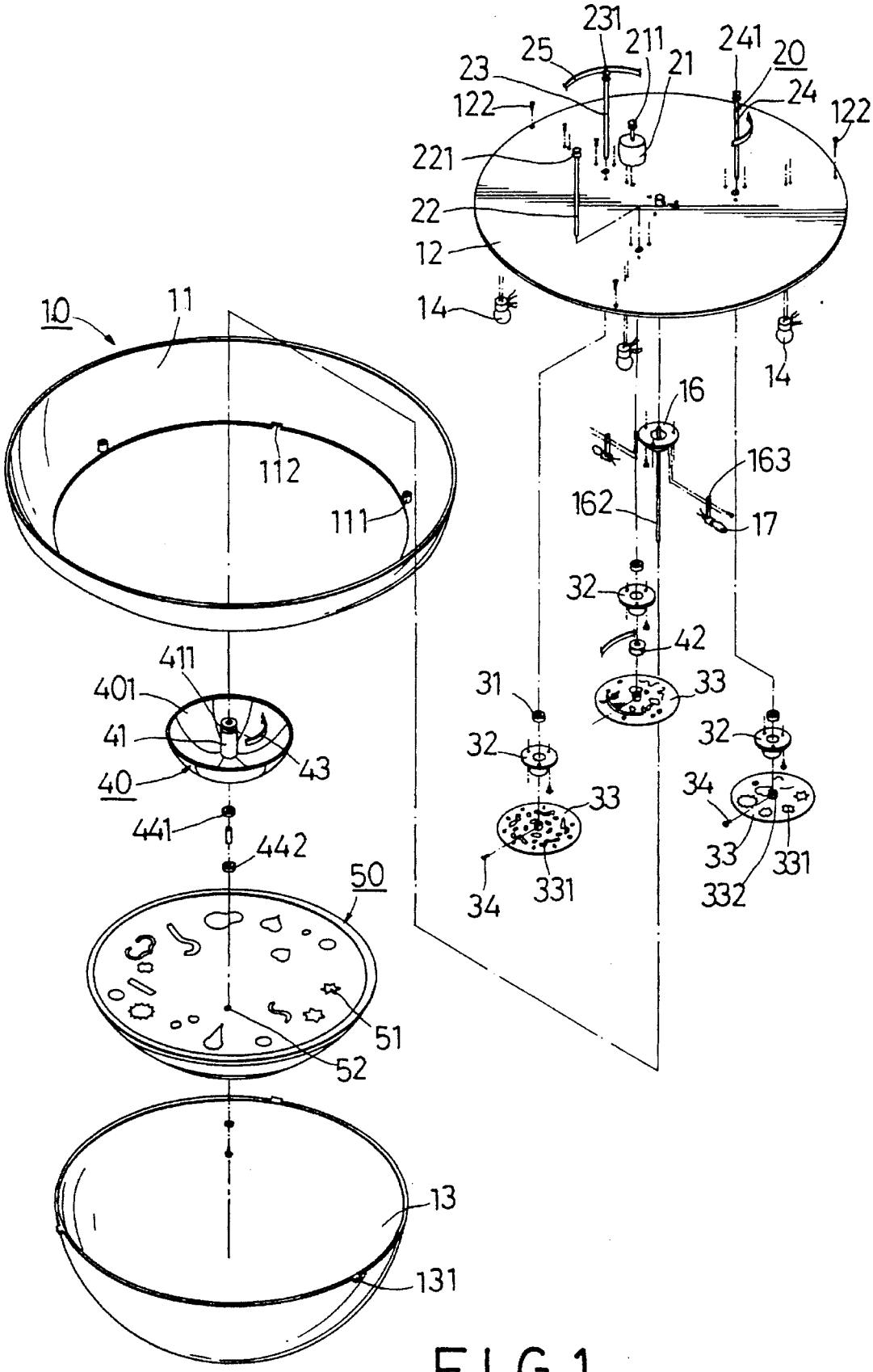
FIG. 1 is an exploded view of a decorative lamp assembly of this invention.
Figure 2:
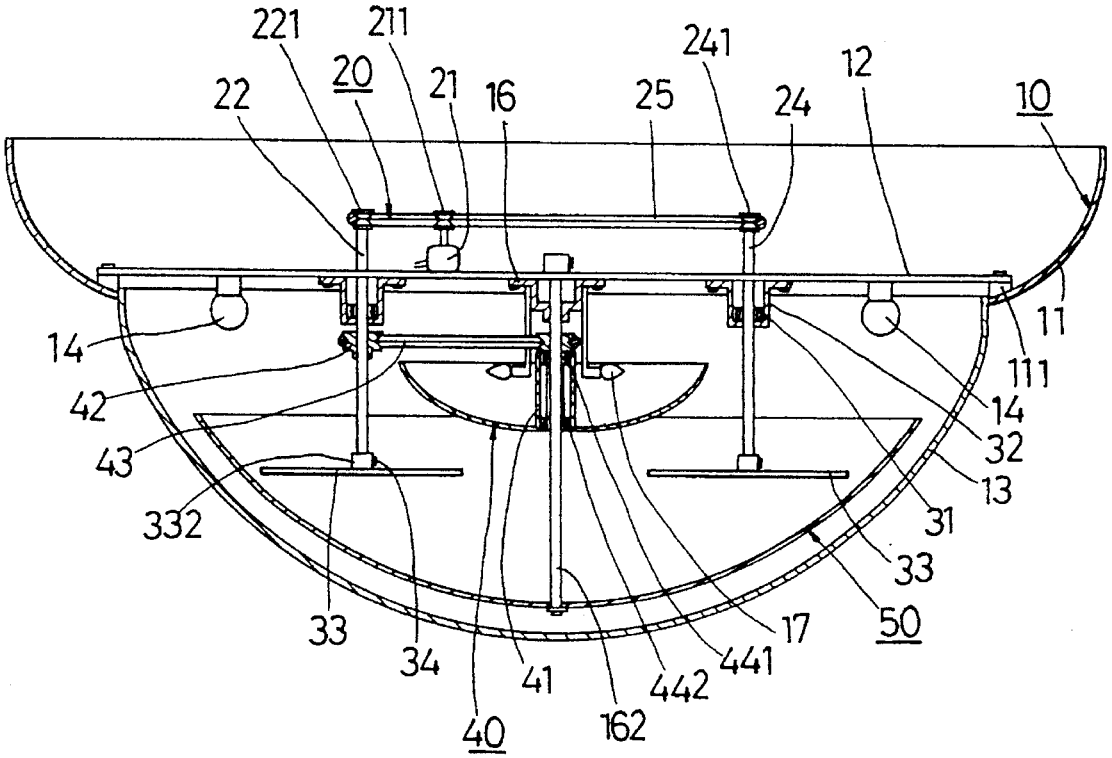
FIG. 2 is a sectional view of the decorative lamp assembly of this invention.
Figure 3:
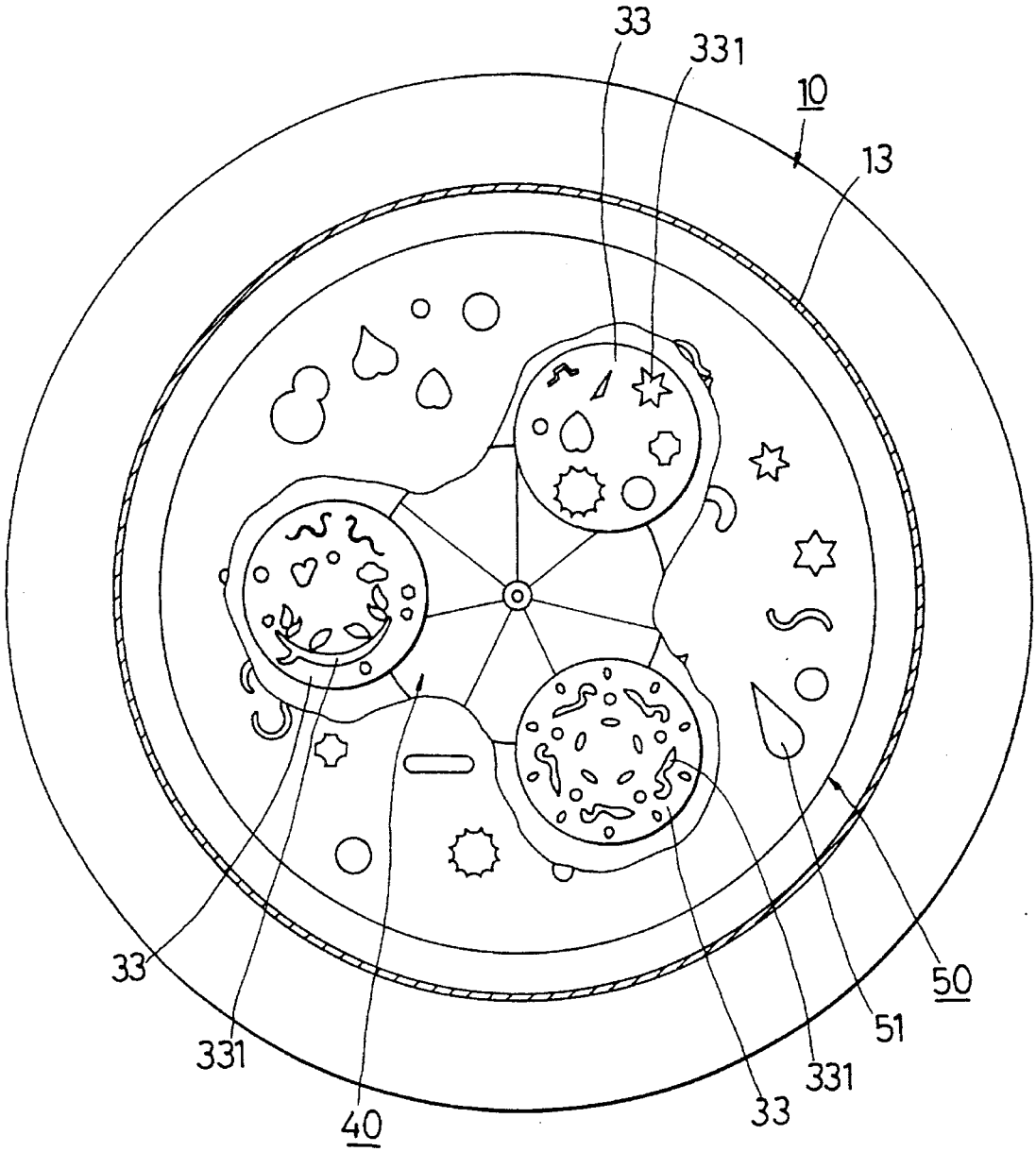
FIG. 3 is another sectional view of the decorative lamp assembly of this invention.

Referring to FIGS. 1, 2 and 3, a decorative lamp assembly of this invention is shown to comprise an enclosure body 10, a driving unit 20, three rotary disks 33, a bowl-shaped cap member 40 and a bowl-shaped rotary member 50.

The enclosure body 10 includes a connecting portion 11 provided with a plurality of peripheral notches 112 and a plurality of positioning tabs 111 secured to the inner surface of the connecting portion 11, a cover portion 13 which has a plurality of projections 131 engaging with the peripheral notches 112, and a mounting disk 12 disposed within the connecting portion 11 and attached detachably to the positioning tabs 111 by means of screws 122.

The driving unit 20 includes a motor 21 installed on the mounting disk 12, an inner bearing seat 16 fastened to the center of the mounting disk 12, three outer bearing seats 32 fastened to the mounting disk 12 so as to mount three bearings 31 therein, and four parallel shafts 22, 23, 24, 162 journalled on the bearing seats 32, 16 in such a manner that the shafts 22, 23, 24 extend through the seats 32 respectively. Each of the shafts 22, 23, 24 is provided with a fixed belt pulley 221, 231, 241. The motor 21 has a motor shaft provided with a fixed belt pulley 211 connected to the pulleys 221, 231, 241 of the shafts 22, 23, 24 by a transmission belt 25.

The rotary member 50 has a central portion 52 fixed to the shaft 162. The rotary member 50 is made from a transparent material and has a pattern unit 51 indicated thereon. The pattern unit 51 is constituted by pictures drawn thereon by using opaque paint.

An electric bulb unit includes a plurality of small bulbs 17 fixed on the peripheral portion of the bearing seat 16 by a plurality of support rods 163.

Each of the rotary disks 33 is made from a transparent material and has a pattern unit 331 formed thereon in a manner similar to that of the rotary member 50. Each of the rotary disks 33 has a central connecting portion 332 fixed to the distal end of the corresponding shaft 22, 23, 24 by a screw 34 such that the disks 33 are located within the rotary member 50 between the bulb unit and the cover portion 13.

The cap member 40 is disposed in the enclosure body 10 between the bulb unit and the rotary disks 33 in such a manner that the cap member 40 covers the bulb unit. The cap member 40 is transparent and is provided with a plurality of colored sections 43. The cap member 40 has a tubular sleeve 41 sleeved rotatably on the shaft 161 by bearing means 441, 442. The tubular sleeve 41 of the cap member 40 has an upper end portion provided with a fixed belt pulley 411 so that a transmission belt 43 interconnects the pulley 411 and another belt pulley 42 fixed on the shaft 22.

When the bulb unit is energized, rays of light emitted from the small bulbs 17 pass through the cap member 40, the rotary disks 33 and the rotary member 50 and penetrate partially into the cover portion 13 to display silhouettes of the pattern units 131 of the rotary disks 33 and silhouettes of the pattern unit 51 of the rotary member 50 on the external surface of the cover portion 13.

When the electric bulb unit is energized and the rotary disks 33, the rotary member 50 and the transparent cap member 40 are driven to rotate, the silhouettes of the pattern unit 331 of each of the rotary disks 33 and the rotary member 30 are displayed movingly in different colors on the external surface of the cover portion 13 of the enclosure body 10. The silhouettes of the pattern units 331, 51 of the rotary disks 33 and the rotary member 50 may overlap one another so as to provide double silhouetting effects to create a more pleasant environment.

In this embodiment, an illuminating lamp unit constituted by a plurality of large bulbs 14 is mounted on the mounting disk 12 and can be energized independently of the bulb unit.

With the present invention thus explained, it is obvious to those skilled in the art that various modifications and variations can be made without departing from the scope and spirit thereof. Therefore, the present invention is intended to be limited only as in the appended claims.

I claim:

1. A decorative lamp assembly comprising:

an enclosure body having a cover portion formed with an external surface;

an electric bulb unit fixed in said enclosure body and including a small bulb unit consisting of a plurality of spaced small bulbs mounted in a central section of said enclosure body and a large bulb unit consisting of a circle of circumferentially arranged large bulbs;

a bowl-shaped transparent rotary member mounted rotatably in said enclosure body and located between said cover portion and said small bulbs, and between said cover portion and said large bulbs, said rotary member having a pattern unit indicated thereon;

a plurality of transparent rotary disks mounted rotatably within said rotary member between said cover portion and said smaller bulbs, and between said cover portion and said large bulbs, each of said disks having an opaque pattern unit formed thereon, each of said disks further having a vertical axis located radially of said rotary member between said small and large bulbs so that rays of light emitted from said smaller and large bulb units pass through said rotary disks and said rotary member and penetrate partially said cover portion to display silhouettes of said pattern units of said rotary disks and said rotary member on a central portion of the cover portion in an overlapping manner; and a driving unit for rotating said rotary disks and said rotary member.

2. The decorative lamp assembly as defined in claim 1, further comprising a transparent cap member which has a plurality of different colored sections and which is disposed within said rotary member so as to cover said small bulbs in such a manner that each of said rotary disks is located between said cap member and said rotary member cover.

* * * * *